United States Patent [19]

Putkonen et al.

[11] Patent Number: 4,815,614

[45] Date of Patent: Mar. 28, 1989

[54] CONTROL SYSTEM FOR A CRANE

[76] Inventors: Ari Putkonen, Hirvenkatu 2 A 1, SF-24100 Salo; Kalevi Sjoholm, Vaahteratie 8, SF-24260 Salo, both of Finland

[21] Appl. No.: 62,199

[22] Filed: Jun. 15, 1987

[30] Foreign Application Priority Data

Jun. 19, 1986 [FI] Finland ..... 862627

[51] Int. Cl.[4] ..... B66C 13/04

[52] U.S. Cl. ..... 212/146; 340/685; 212/153

[58] Field of Search ..... 212/149–156, 212/146, 147, 255, 261; 340/463, 685

[56] References Cited

U.S. PATENT DOCUMENTS

| | | | |
|---|---|---|---|
| 4,006,347 | 2/1977 | Hohmann | 340/685 |
| 4,222,491 | 9/1980 | Geppert | 212/153 |
| 4,317,524 | 3/1982 | Andersson | 212/146 |

*Primary Examiner*—Sherman D. Basinger
*Assistant Examiner*—Stephen P. Avila

[57] ABSTRACT

The invention relates to a system for controlling the boom of a hydraulic crane, in particular, the crane being provided with at least one load sensor on the basis of which the speed of the boom is controlled so that the greatest permissible speed of the boom increases with decreasing load and correspondingly decreases with increasing load. The drawback of the known systems is that they do not in a satisfactory way consider the dynamic loads the crane is subjected to, wherefore their control properties are unsatisfactory. The problem is eliminated according to the invention so that in order to reduce the dynamic stresses exerted on the crane, the oil flow of the hydraulic actuating means is controlled by directly adjusting the movements of the valves of the actuating means on the basis of a speed instruction of the boom and of a load signal and by filtering such speed instructions which indicate valve movement speeds exceeding a predetermined value.

4 Claims, 3 Drawing Sheets

CONTROL SYSTEM FOR A CRANE

Dynamic loads have to be taken into account in the strength dimensioning of the structure of cranes. Such loads are due to the accelerations and retardations of the boom system itself and particularly those of a load to be lifted.

The highest permissible speed of the boom system of a crane has been determined by a hydraulic pump providing a volume flow set to a predetermined maximum level specific for each particular crane. The volume flow provided has been distributed to the different actuating means, mainly to the hydraulic cylinders, by means of control valves controlled mechanically by means of levers.

A serious drawback has been that the greatest permissible load and speed of the crane have been fixed and independent of each other, i.e. it has been necessary to dimension the crane in view of a situation when a maximum load is displaced at a maximum speed, which has been a frequently occurring situation in practice. It has been possible to effect the starting and stopping movements of the crane very rapidly, on account of which the crane structure is often caused to vibrate during the displacement of the load. Any attempts made by the operator to compensate for the vibration have generally only increased the vibration, because the control movements and the specific frequency of the crane structure together have created an unsuppressed vibration.

This is due to the fact that the movements of the valves of the actuating means of the crane, mainly those of the hydraulic cylinders, have been controlled directly, mechanically. The prevailing opinion among those skilled in the art has been that it is not possible to any greater degree affect the accelerations by reducing the opening and closing speeds of the control valves, because the control of the crane would thereby require anticipation and would become inaccurate and even dangerous.

U.S. Pat. No. 4,006,347 suggests that the load should be taken into account by retarding the movement of the crane boom in the vertical plane when the boom swings from above towards a horizontal position, and, correspondingly, accelerated when the boom moves from below upwards. The control, however, is carried out indirectly by means of an additional valve which bypasses part of the volume flow past the valve of the hydraulic cylinder back to the tank, as a result of which the control is inaccurate, particularly at stages for starting and stopping the boom.

The object of the invention is thus a system for controlling the boom system of a hydraulic crane in particular, whereby the crane is provided with at least one load sensor which provides measuring data on the basis of which the speed of the boom system is controlled so that the greatest permissible speed increases with decreasing load and correspondingly decreases with increasing load.

The object is to provide a new control system in which the dynamic loads exerted on the crane are taken into account better than in known systems.

The system according to the invention is mainly characterized in that in order to reduce the dynamic stresses exerted on the crane, the oil flow of the hydraulic actuating means is controlled by directly adjusting the movements of the valves of the actuating means on the basis of a speed instruction of the boom and of a load signal and by filtering such speed instructions which indicate valve movement speeds exceeding a predetermined value.

Thus the dynamic stresses caused by the accelerations of the load are reduced in the control system according to the invention by preventing the control valve from opening and closing too rapidly and by decreasing the speed of the movements of the crane at high loads in particular. The filtration of the control movements of the operator decreases the accelerations, compensates for the disadvantageous effects of error movements and improves the control properties. By virtue of reduced variation in the dynamic stresses, the lifting power of the crane can be increased and the steering properties improved; further, the durability of the boom structures can be improved or the structures can be lightened.

The hydraulic valves are controlled electrically. The oil flow controllable by the operator is regulated by varying the electric control signal on the basis of the load data. The volume flow of oil is thereby regulated by means of the same valve by means of which the crane is controlled anyway. An advantage of this arrangement is that the number of the hydraulic components need not be increased.

The control system of the crane can preferably be constructed in the following way.

The system comprises a programmable digital control unit which effects the adjustment of the maximum speed on the basis of the information obtained from the load sensor. The control unit comprises a digital filter element which monitors the speed of the movements of the control levers, filters away excessive frequencies and effects the accelerations and retardations in a stepped manner. All the control and monitoring functions of the control unit can be programmed separately for each crane and actuating means.

In the following the invention will be described in more detail with reference to the attached drawing.

Figure 1:
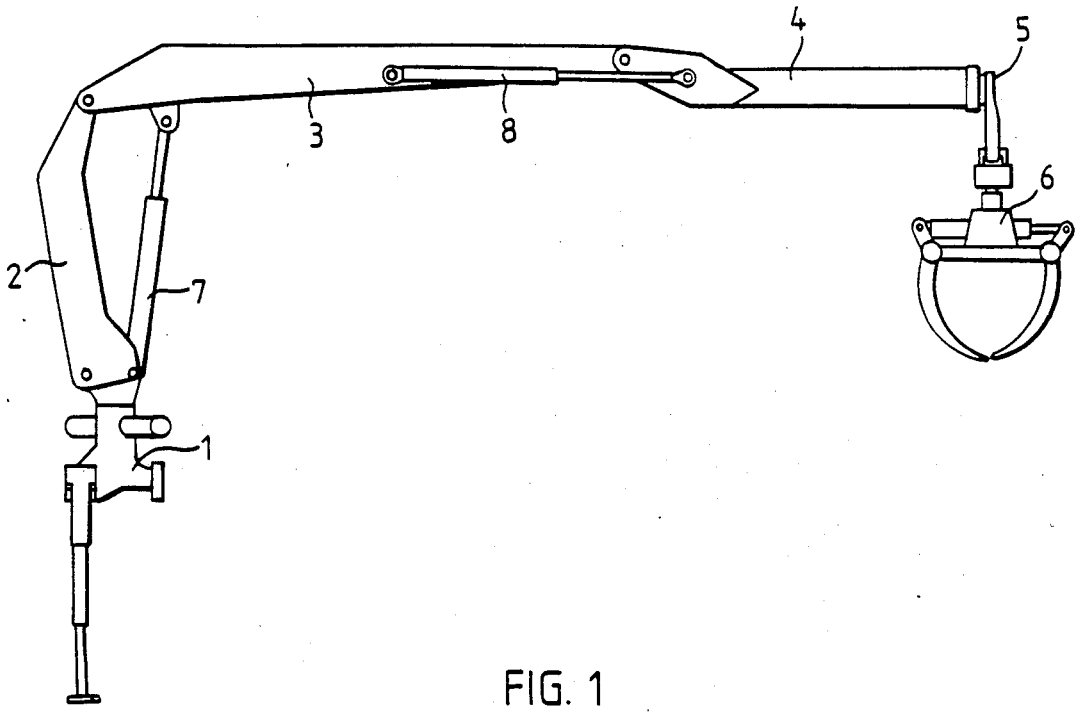
FIG. 1 is a side view of a crane.

The crane shown in FIG. 1 comprises a base 1, a pillar 2, a lifting boom 3, a displacing boom 4 and an extension 5 thereof, a grab 6, a lifting cylinder 7 and a displacing cylinder 8.

The load of the crane exerts the heaviest stress on the pillar 2 and the lifting cylinder 7, on account of which at least one load sensor according to the system is preferably positioned either in the pillar or in the lifting cylinder. The load sensor may, for instance, measure the pressure in the lifting cylinder, or in its feeding hose, or a strain gauge may be attached to the surface of the pillar.

Sensors suited for the purpose are easily available; their structure and operation need not be more closely described here.

Figure 2:
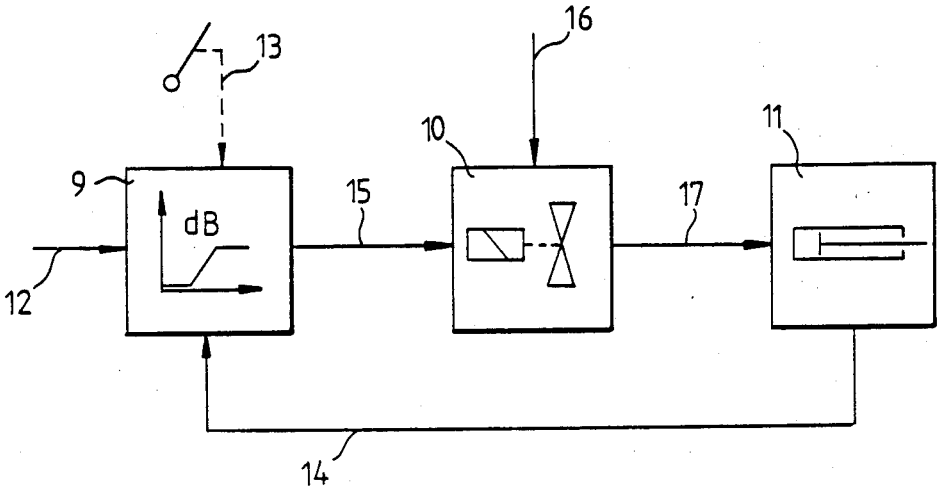
FIG. 2 is a general diagram of the control system.

In FIG. 2, the block 9 represents an electronic control unit, the block 10 a control valve system and the block 11 controllable actuating means (hydraulic cylinders). The arrow 12 designates a supply wire of a power source, the arrow 13 speed instructions given by the operator, the arrow 14 load data, the arrow 15 a control signal of the valve and the arrows 16 and 17 the oil flow.

Figure 3:
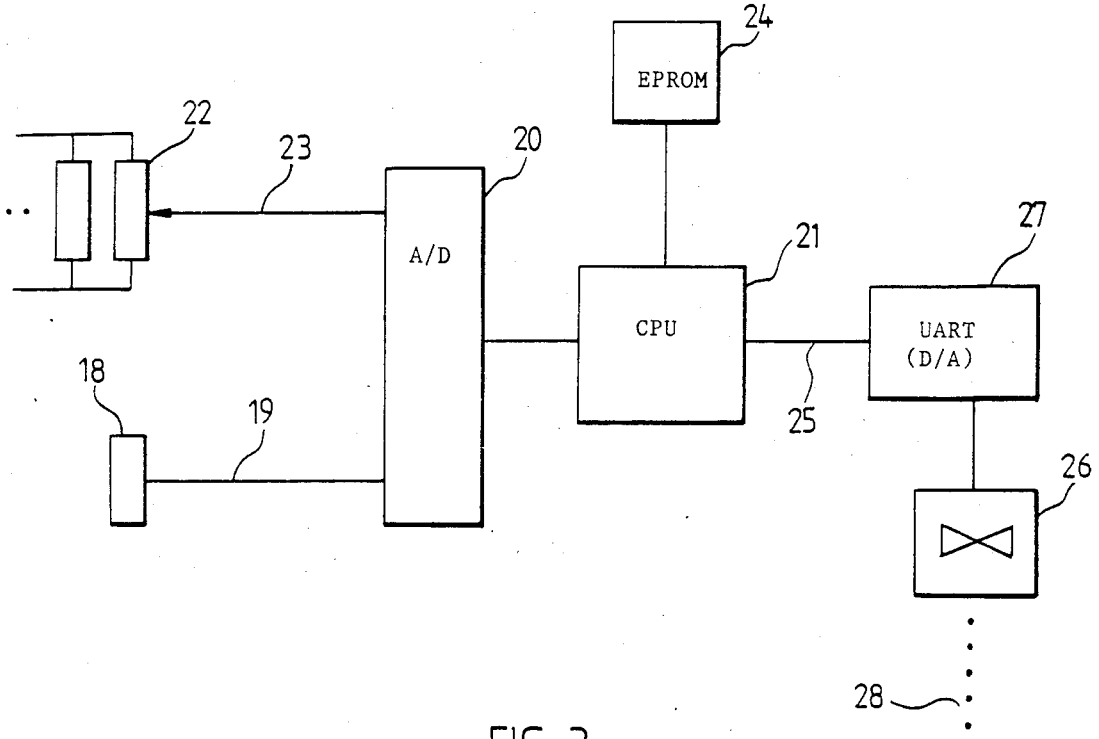
FIG. 3 is a block diagram of the electronical control unit.

In FIG. 3, the reference numeral 18 designates a load sensor which provides a voltage signal 19 which is modified in an analog to digital converter 20 to be applied to a microprocessor 21 in digital form. Speed instructions 23 obtained from a control potentiometer 22 are likewise modified in the A/D converter 20 to be applied to the microprocessor 21 in digital form. On the basis of the speed instructions and the load signal, the microprocessor 21 performs the control and filtration calculations of the speed instructions according to a control program stored in a non-volutile memory 24. The modified speed instructions are transmitted to the control valves 26 from a serial transmission controller 27. The control quantity of the valve may also be an analogous electrical signal, a digital to analog converter being used in place of the serial transmission controller.

One preferred embodiment will be described in more detail in the following.

The system comprises a digitally controllable control valve, control electronics, electronical control levers and a pressure sensor.

Three actuating means (hydraulic cylinders) can be controlled, either simultaneously or separately, by means of two control levers attached near to the driver's seat. Three potentiometers are positioned in connection with the control lever in such a manner that when the lever is turned, two of the potentiometers are deviated from their mid position to one direction or the other, and when press buttoms provided in the lever are pressed, the third potentiometer is deviated. All the potentiometers are connected in parallel to a direct-current voltage of 5 V, so that when the potentiometer is in the mid position, the output voltage will be 2.5 V. Accordingly, six output voltages varying between 0 V and 5 V are obtained from the control lever, depending on the position of the control levers at each particular moment. When the output voltage is less than 2.5 V, the hydraulic cylinder is retracted and, correspondingly, when the voltage exceeds 2.5 V, the hydraulic cylinder is displaced outwards, i.e. the length thereof increases. When the voltage is 2.5 V, the cylinder stays in place. The more each output voltage approaches 0 V or 5 V, the greater the speed instruction the respective actuating means receives.

The control voltages are connected to a control unit in which the data is modified and processed and transmitted further to the control valves. The control unit comprises e.g. a microprosessor, an analog to digital converter, a program memory, a working memory, a serial transmission controller and an oscillator crystal. The program memory is of the Read Only type, being programmed by means of a separate programming device. The data stored in the program memory is preserved over breaks occurring in the flow of electric current. The control program is an endless program loop which is repeated many times per second when the device is in operation.

Figure 4:
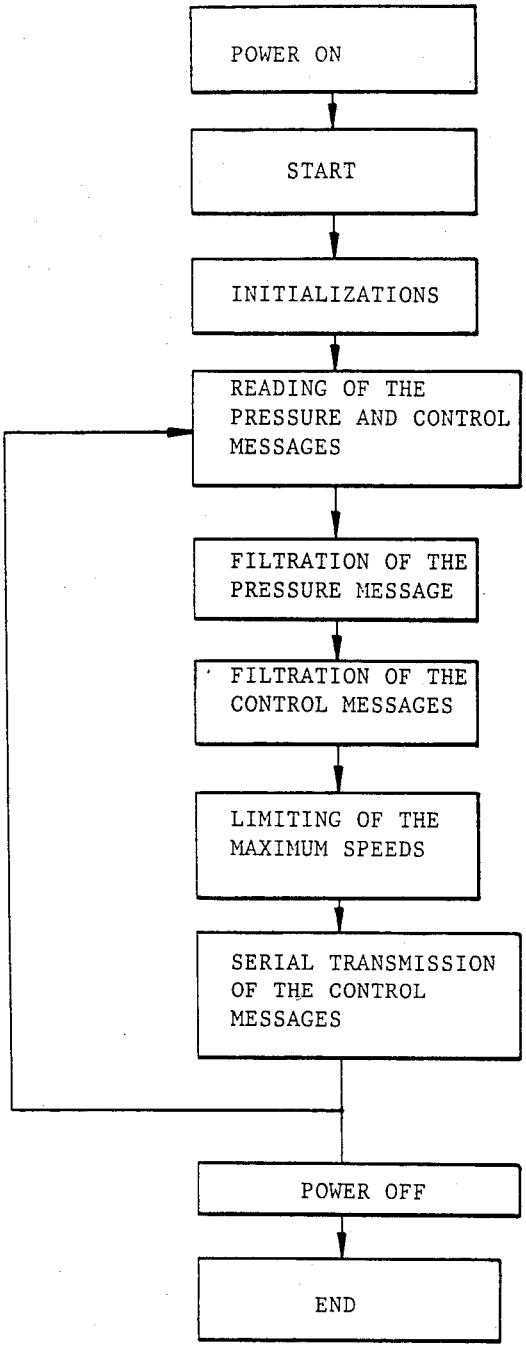
FIG. 4 is a block diagram of a preferred specific program stored in the program memory of the control unit.

The block diagram of the program stored in the program memory is shown in FIG. 4. When voltage is connected to the control unit, the processor starts to perform the program stored in the program memory. The processor first performs the initializations required by the interrupting controller and by the serial transmission controller, by writing predetermined syllables in the registers 30 of said controllers. The registers are located in a so called ramdom access memory in which the stored data disappears when a break occurs in the flow of electric current.

The performance of the program loop is started by reading the control signals. These control signals include the control voltages (six in number) from the control levers and the voltage from the pressure sensor. The pressure sensor is a strain gauge type sensor the maximum output of which is 100 mV for a supply voltage of 10 V, so that the pressure signal is amplified to a level 0 to 5 V before it is applied to the analog to digital converter. The analog to digital converter converts the voltages corresponding to the control signals into a digital form (with 0–225 decimals) 31. Thereafter the pressure signal is filtered so as to determine the average pressure level in the lifting cylinder, whereby the pressure peaks caused by the swingings of the load do not affect this level. The filtration prevents the control system from getting resonant with the swingings of the load 32. The filtration is effected by means of a mathematical algorithm in which a new filtered value is obtained by adding the difference of a rating and a previous filtered value to the previous filtered value, the difference being multiplied with a predetermined parameter; in the form of a formula $X2=X1+a*(0-X1)$, wherein $X1$=previous filtered value, $X2$=new filtered value, a =parameter, 0=rating. By varying the parameter a, a desired filtration function is obtained. In practice, the filtration causes the new filtered value X2 to obtain the rating in a stepwise manner, i.e. in a predetermined rise time specific for the filter.

Thereafter the control signals obtained from the control levers are filtered by means of the above-mentioned algorithm 33. The filtering parameters of the different control signals can be chosen to meet the requirements of each particular crane. The opening and closing speeds of the desired control valves are reduced by the filtration of the control messages and, as a consequence, the accelerations and retardations of the actuating means and the load are also reduced.

Figure 5:
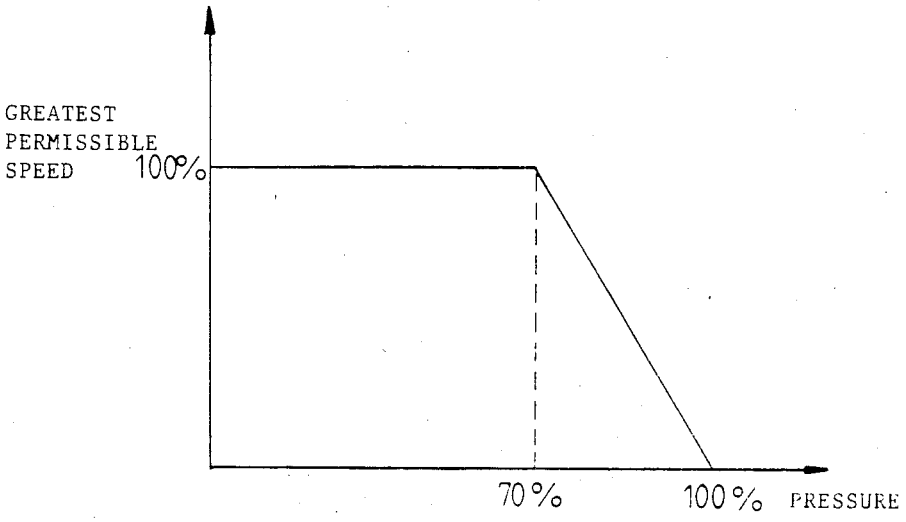
FIG. 5 shows an example function between pressure and speed.

The adjustment of the speed of movement of an individual actuating means is carried out on the basis of the pressure signal 34. The control program increases the greatest permissible speed of the actuating means when the pressure signal is decreased and correspondingly decreases it when the pressure signal is increased e.g. according to the function shown in FIG. 5. The effect of the pressure signal on the maximum speed of movement of the actuating means may vary from one actuating means to another.

The pressure signals measured initially from the control levers are modified on the basis of the control and loading state of the crane to be applied to the control valves. At the end of the program loop, the control signals are applied through the serial transmission controller to the valves 35. The control valve is a valve which can be controlled by means of a digital control in serial form. The decoding of the control signals and the adjustment of the valve to a desired position are carried out in the valve itself.

The crane usually comprises several control valves for the different movements; in FIG. 3, these valves are merely outlined by means of dots 25 for the sake of simplicity. As appears from FIG. 3, the operation of all the required valves can be altered by varying the control program so that the desired operation is obtained with each actuating means and crane.

We claim:

1. A system for controlling the boom of a hydraulic crane, in particular, the crane being provided with at least one load sensor on the basis of which the speed of the boom is controlled so that the greatest permissible speed of the boom increases with decreasing load and correspondingly decreases with increasing load, wherein in order to reduce the dynamic stresses exerted on the crane, the oil flow of the hydraulic actuating means is controlled by directly adjusting the speed of the movements of the valves of the actuating means on the basis of a speed instruction (13) of the boom and of a load signal (14) and by filtering such speed instructions which indicate valve movement speeds exceeding a predetermined value.

2. A system according to claim 1, wherein the hydraulic valves are controlled electrically and that the oil flow controllable by the operator is regulated by limiting the electric control signal on the basis of the load date.

3. A system according to claim 2, wherein the volume flow of oil is regulated by means of the same valve as used for the general control of the crane.

4. A system according to claim 1, comprising a programmable, preferably digital regulating unit for regulating the respective maximum speed, said regulating unit including a preferably digital filter means for monitoring the movement speeds of control lever and for filtering excessive frequencies.

* * * * *